US008100634B2

(12) United States Patent
Evans

(10) Patent No.: US 8,100,634 B2
(45) Date of Patent: Jan. 24, 2012

(54) VANE AND A VANE ASSEMBLY FOR A GAS TURBINE ENGINE

(75) Inventor: Dale E. Evans, Derby (GB)

(73) Assignee: Rolls-Royce PLC, London (GB)

( * ) Notice: Subject to any disclaimer, the term of this patent is extended or adjusted under 35 U.S.C. 154(b) by 735 days.

(21) Appl. No.: 12/232,238

(22) Filed: Sep. 12, 2008

(65) Prior Publication Data

US 2009/0097963 A1 Apr. 16, 2009

(30) Foreign Application Priority Data

Oct. 11, 2007 (GB) ..... 0719786.6

(51) Int. Cl.
*F01D 5/14* (2006.01)

(52) U.S. Cl. ..... 415/115; 416/97

(58) Field of Classification Search ..... 415/115, 415/172, 173; 416/96, 97
See application file for complete search history.

(56) References Cited

U.S. PATENT DOCUMENTS

| | | | | |
|---|---|---|---|---|
| 3,767,322 | A | 10/1973 | Durgin et al. | |
| 4,802,823 | A | 2/1989 | Decko et al. | |
| 5,358,379 | A | 10/1994 | Pepperman et al. | |
| 6,905,301 | B2 * | 6/2005 | Tiemann | 415/115 |
| 2005/0076504 | A1 | 4/2005 | Morrison et al. | |
| 2007/0243070 | A1 | 10/2007 | Matheny | |

FOREIGN PATENT DOCUMENTS

| | | | |
|---|---|---|---|
| CA | 2 557 236 | A1 | 2/2007 |
| DE | 286 016 | A5 | 1/1991 |
| EP | 1 803 901 | A2 | 7/2007 |
| WO | WO 98/31922 | A1 | 7/1998 |

* cited by examiner

*Primary Examiner* — Quoc Hoang

(74) *Attorney, Agent, or Firm* — Oliff & Berridge, PLC

(57) ABSTRACT

A fan outlet guide vane for a gas turbine engine comprises a generally radially-extending internal structural member and at least one surface member securable in use to the internal structural member so as to define an aerofoil. The gas turbine engine includes an annular first structure and an annular second structure, the second structure being radially outward of the first structure so as to define a duct between them, and in use the internal structural member of the vane is secured between the first structure and the second structure. In a preferred embodiment, the surface member or surface members are secured only to the internal structural member, and not to the first or second structures.

15 Claims, 2 Drawing Sheets

VANE AND A VANE ASSEMBLY FOR A GAS TURBINE ENGINE

This invention relates to gas turbine engines, and more particularly to the fan outlet guide vanes in such engines.

The fan outlet guide vanes (OGVs) direct the bypass air flow after it has been compressed by the fan. They also provide a structural link between the engine core and the fan casing.

Conventionally, structural OGVs are made from metal, and are bolted or welded to the inner and outer rings. Both hollow and solid vanes are known. A known technique for making such vanes from titanium is by diffusion bonding and blow forming, but such vanes are very expensive.

It is also known to make some of the OGVs non-structural. Typically, the vanes are alternately structural (as above, metal, and welded to the inner and outer rings) and non-structural (made of composite material and bolted to the inner and outer rings). This construction offers a weight reduction over a full set of metal, structural vanes but introduces complication because there are two (or more) distinct vane standards and the different vane standards may require different attachment methods.

It is known for some of the vanes in a set to have different stagger and/or camber from the others in the set. This aerodynamic variation, sometimes referred to as cyclic stagger and camber, is introduced to prevent upstream fan forcing arising from downstream obstructions such as the upper and lower bifurcation features in the bypass duct that carry services and support the engine.

Conventional vane arrangements also have the disadvantage that repair or replacement of damaged vanes is difficult, especially on those vanes that are welded to the inner and outer rings.

It is therefore an object of this invention to provide a vane for a gas turbine engine that substantially overcomes the disadvantages of known vanes, and that reduces cost and weight compared with known vanes.

According to the invention, there is provided a vane for a gas turbine engine and a vane assembly for a gas turbine engine as claimed in the independent claims.

The invention will now be described, by way of example, with reference to the accompanying drawings in which.

Figure 1:
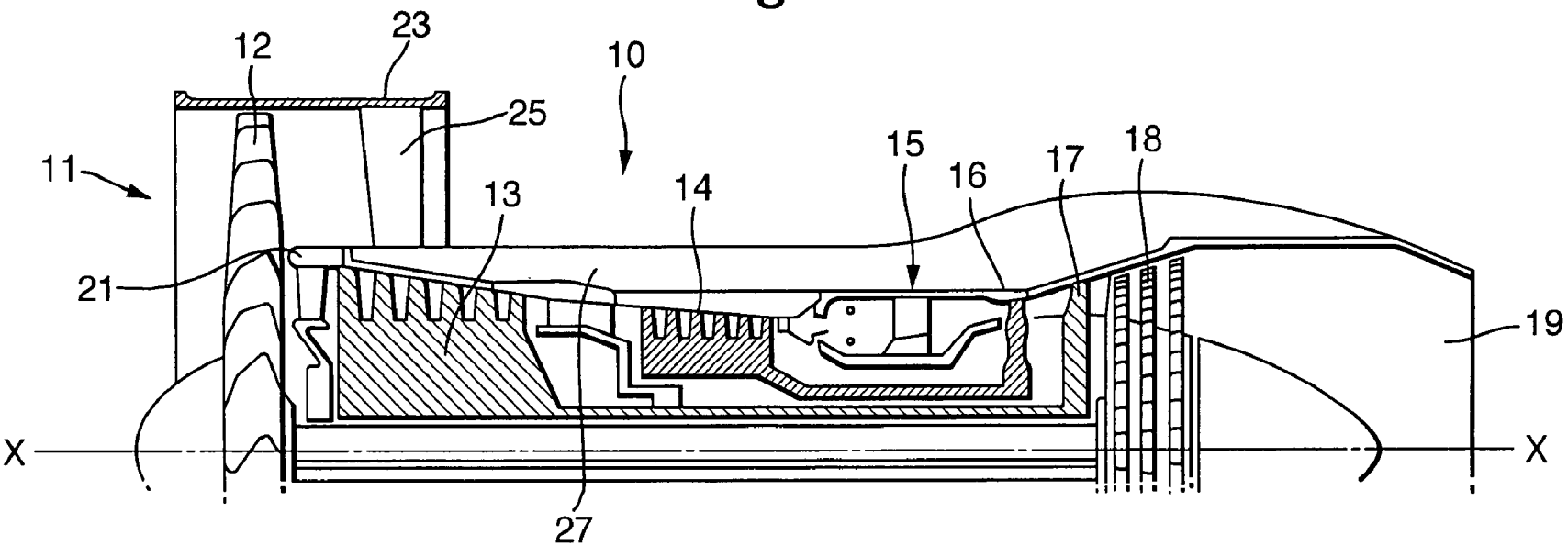
FIG. 1 is a sectional side view of the upper half of a gas turbine engine.

Referring first to FIG. 1, a gas turbine engine generally indicated at 10 has a principal axis X-X. It comprises, in axial flow series, an air intake 11, a propulsive fan 12, an intermediate pressure compressor 13, a high pressure compressor 14, a combustor 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12. The accelerated air flow is split by the annular inner ring 21 into two air flows: a first air flow into the intermediate pressure compressor 13 and a second air flow which provides propulsive thrust.

The second air flow is directed through a flow passage defined by the inner ring 21 and the annular fan casing 23, and flows through an annular array of fan outlet guide vanes (OGVs) 25. As well as guiding the second air flow, the OGVs provide (at least in three-shaft engines) a structural link between the engine core 27 and the fan casing 23.

The intermediate pressure compressor 13 compresses the first air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
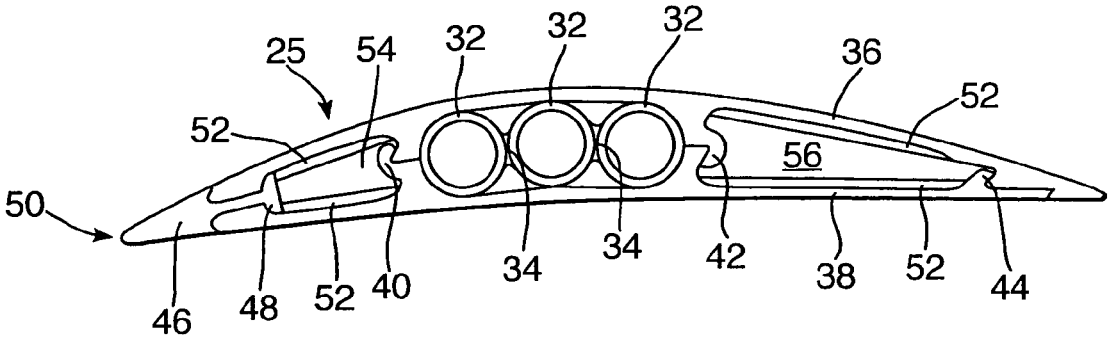
FIG. 2 is a sectional plan view of an outlet guide vane according to the invention.

Referring now to FIG. 2, a vane 25 according to the invention has an internal structural member comprising three metal tubular members 32. These are welded together along their lines of contact 34. In use, a vane assembly will comprise a plurality of such internal structural members each secured at its ends to the inner ring 21 and to the fan casing 23, as will be explained in more detail later.

Two surface members 36, 38 fit around each of the tubular members 32, and are secured to each other by means of interlocking features 40, 42, 44. This also provides positive location of the surface members with respect to the internal structural member. The surface members 36, 38 are injection moulded from plastics material. The surface members are not secured to the inner ring 21 or to the fan casing 23, and so in use effectively all the loads between the inner ring 21 and the fan casing 23 are transmitted by the internal structural members of the plurality of vanes, and not by the surface members. The surface members do carry and react gas loads.

A leading edge member 46 is secured between the surface members 36, 38 by means of interlocking features 48, and defines a leading edge 50 of the vane 25. The leading edge member 46 is made of metal, which provides greater resistance to erosion and foreign object damage in service.

The surface members 36, 38 are provided with integral stiffening ribs 52 to provide greater mechanical integrity.

The surface members 36, 38 define spaces 54, 56 within the vane 25. With suitable design of the surrounding structures, one or both of these spaces 54, 56 may be used to carry anti-icing air for the vane 25. Ejection holes for this air could be pre-moulded in the surface members.

The tubular members 32 are hollow. With suitable design of the surrounding structures, one or more of these tubular members 32 may be used as a fluid conduit for oil or for air to supply the engine internal air systems.

Figure 3:
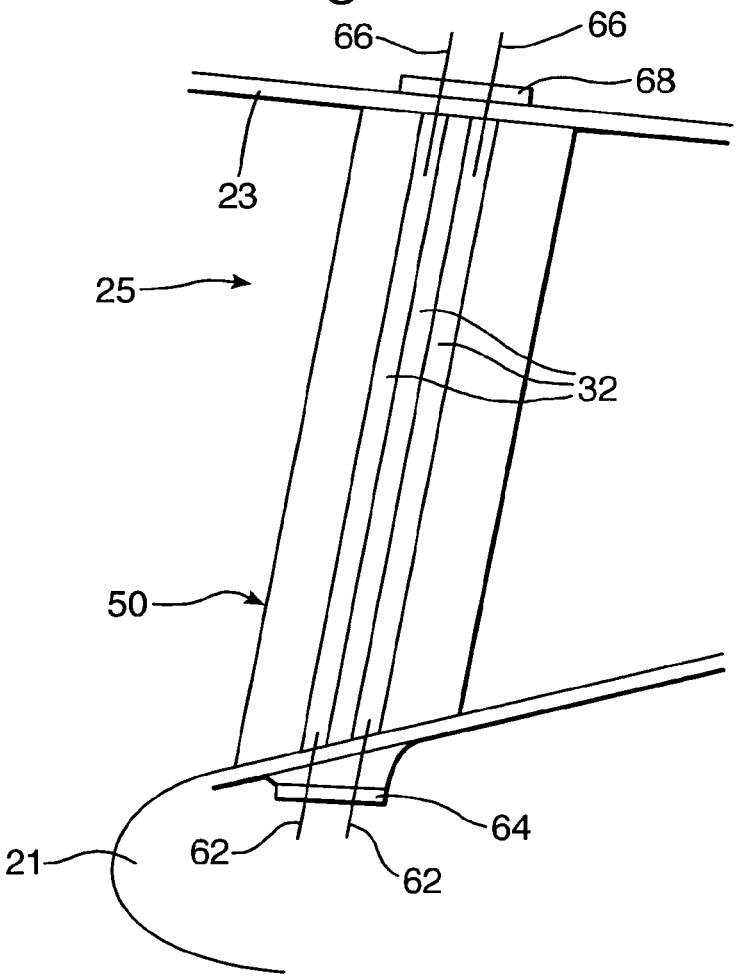
FIG. 3 is a sectional side view of the outlet guide vane of FIG. 2.

FIG. 3 shows a side sectional view of the vane of FIG. 2. The leading edge 50 of the vane 25, and the three tubular members 32, are clearly seen. The vane 25 extends, as shown in FIG. 1, between the inner ring 21 and the fan casing 23.

The vane 25 is secured to the inner ring 21 by two bolts 62, which pass through a load spreading plate 64. The vane 25 is likewise secured to the fan casing 23 by two bolts 66, which pass through a load spreading plate 68. On assembly, the degree of tightening of the bolts 66 on the different vanes in the assembly may be adjusted to ensure that the fan casing 23 assumes its correct circular shape.

The load spreading plates 64, 68 may be integral with the inner ring and fan casing, or may be discrete components.

The invention also offers advantages in those circumstances where cyclic stagger and camber is to be used on some vanes. The internal structural members can be of whatever configuration is required, and surface members of different aerodynamic standards can be readily attached where they are needed. These surface members may be differently coloured, or otherwise distinguished, to enable quick identification of the vanes that incorporate the aerodynamic variation.

It will be appreciated by the skilled reader that other modifications and variations may be made to the embodiment described in this specification, without departing from the claimed invention.

For example, the internal structural member of the vane 25 may be constructed from rods, wires, cables, pipes, ducts, bars or any other suitably shaped members instead of tubular members. Fewer or more such members 32 than the three described may be used. All of the members need not be of the same form, and they may have different cross-sectional areas. Other materials besides metal may be used.

The aerofoil described is defined by two surface members 36, 38 and the leading edge member 46, but it may be made up from a different number of surface members. The surface members 36, 38 in the embodiment described form the suction and pressure surfaces of the aerofoil, respectively. In other embodiments the surface members may be disposed differently—for example, two members forming the front and rear of the aerofoil, or four members forming front suction, front pressure, rear suction and rear pressure surfaces.

The surface members may be made from any suitable material. They may for example be metal, plastic or composite, or may comprise a flexible membrane stretched over a frame. The surface members may be made by any method appropriate for the material in question.

The interlocking members 40, 42, 44, 48 may be continuous along the length of the surface members 36, 38; or they may be discontinuous, and provided only at selected places along the length. Alternatively, other means of securing the surface members together may be used. A mechanism may be provided for unlatching the interlocking members, so that the surface members may be removed for maintenance or repair.

The interlocking members may act to secure the surface members only to each other. Alternatively or additionally, the interlocking members may secure one or more of the surface members to the internal structural member.

Lugs or other features may be included in the interlocking members to provide radial location of the surface members, relative to each other or relative to the internal structural member.

In certain embodiments, the internal structural member may extend outwards to form part of the aerofoil surface. In such cases, the surface members defining the front and rear parts of the aerofoil surface will necessarily be separate, and each will attach separately to the internal structural member.

The leading edge member 46, instead of being a separate component, may be an integral part of a surface member.

In certain applications the stiffening ribs 52 may not be required.

Depending on the configuration of the surface members and the internal structural member, fewer or more spaces 54 may be defined within the vanes 25, or there may be no spaces at all.

The invention has been described with reference to a fan outlet guide vane for a gas turbine engine. However, it will be appreciated that the principles of the invention may equally well be applied to other stationary components in the flow paths of gas turbine engines; for example, for the engine section stator or for other supports, whether in the bypass duct or in the core.

I claim:

1. A vane for a gas turbine engine, the vane comprising
an internal structural member and
a plurality of surface members, at least one surface member being securable in use to the internal structural member so as to define an aerofoil, wherein
the plurality of surface members are secured together in use by interlocking features provided on their respective surfaces, the plurality of surface members cooperating to define the aerofoil.

2. The vane of claim 1, in which interlocking features are also provided on the internal structural member.

3. The vane of claim 1, and further comprising a leading edge member, the leading edge member associated with the surface member or surface members so as to define in use a leading edge portion of the aerofoil.

4. The vane of claim 3, in which the leading edge member is secured in use to at least one surface member by interlocking features provided on their respective surfaces.

5. The vane of claim 1, in which the internal structural member comprises a plurality of tubular support members.

6. The vane of claim 5, in which at least one tubular support member of the internal structural member serves in use as a fluid conduit.

7. The vane of claim 1, in which the internal structural member comprises a plurality of metal tubes secured together.

8. The vane of claim 1, in which at least one surface member includes one or more strengthening ribs.

9. The vane of claim 1, in which the surface members when secured around the internal structural member define a space, and the space serves in use as a conduit for anti-icing air.

10. The vane of claim 9, in which ejection holes for the anti-icing air are provided in at least one surface member.

11. A vane arrangement for a gas turbine engine, the engine including first structure and second structures that together defining a duct, the arrangement comprising:
the vane of claim 1, in which the internal structural member is secured in use to the first and second structure.

12. The vane arrangement of claim 11, in which the internal structural member is bolted to the first and second structures with bolts.

13. The vane arrangement of claim 12, in which the degree of tightening of the bolts can be altered to adjust the shape of the second structure.

14. A vane assembly for a gas turbine engine, the assembly comprising a plurality of vane arrangements as in claim 11.

15. The vane assembly of claim 14, in which the aerofoil of at least one vane has a stagger and/or camber different from the other aerofoils.

* * * * *